US008220733B2

(12) United States Patent
Zhong

(10) Patent No.: US 8,220,733 B2
(45) Date of Patent: Jul. 17, 2012

(54) WATER COOLING PAPER SHREDDER

(76) Inventor: Fengqiang Zhong, Guangzhou (CN)

( * ) Notice: Subject to any disclaimer, the term of this patent is extended or adjusted under 35 U.S.C. 154(b) by 98 days.

(21) Appl. No.: 12/772,526

(22) Filed: May 3, 2010

(65) Prior Publication Data

US 2011/0186671 A1 Aug. 4, 2011

(30) Foreign Application Priority Data

Jan. 29, 2010 (CN) ..... 2010 2 0114798 U

(51) Int. Cl.
*B02C 13/20* (2006.01)

(52) U.S. Cl. ..... 241/236; 241/301

(58) Field of Classification Search ..... 241/100, 241/236, 295, 301

See application file for complete search history.

(56) References Cited

U.S. PATENT DOCUMENTS 4,725,006 A * 2/1988 Jaggi ..... 241/46.017
6,213,417 B1 * 4/2001 Schwelling ..... 241/36
6,575,391 B1 * 6/2003 Brown et al. ..... 241/60

* cited by examiner

*Primary Examiner* — Faye Francis

(74) *Attorney, Agent, or Firm* — George D. Liu; Ronda IP Agent Co., Ltd

(57) ABSTRACT

A water cooling paper shredder includes a power management unit; and a shredding mechanism. The shredding mechanism includes a motor, a conveying mechanism and a pair of shredding rollers, the motor being powered by the power management unit, torque of the motor being transferred by the conveying mechanism to the pair of the shredding rollers, thus causing shredding action of the shredding rollers. A heat dissipation device is provided on the motor to conduct heat outside of the motor itself. The temperature of the stator portion can be reduced effectively using water cooling technique and finally, causing temperature reduction within the motor. Therefore, the paper shredder can be cooled with high efficiency.

5 Claims, 3 Drawing Sheets

WATER COOLING PAPER SHREDDER

FIELD OF THE INVENTION

The invention relates generally to a water cooling paper shredder.

BACKGROUND OF THE INVENTION

Paper shredders have been increasingly gaining popularity. Among components of a paper-shredding mechanism of a typical paper shredder, the motor and conveying roller provided with a cutter thereon are particularly important components. Comparatively, corresponding control circuits and enclosure are simple in construction. Improvements to paper shredders are extremely limited due to their long time existence in the marketplaces. Many manufacturers have been continuously developing their new products to stand in the market. However, improvements are relatively confined due to the very simple structure of known paper shredders. Accordingly, it is inevitable for these manufacturers to lower the price of the shredders in order to gain the profits from the marketplace.

To reduce costs, manufacturers have made efforts to improve shredding capability of the shredders on one hand; and on the other hand, they adopt inexpensive components. For example, costs will be reduced if plastic enclosure other than a metal enclosure is used to encase the rest of the components of the shredder. Enhancement of shredding performance is typically realized by improving performance of the motor. In doing so however, power consumption of the motor is also increased. According to Joule's Law, it will also cause a dramatic increase of the heat generated by the paper shredder. In particular, the shredders (mainly the motors) currently used in offices, for example, where a high quantity of paper is shredded, the shredders often halt due to overheating, thus decreasing the shredding efficiency. Even for offices where the paper-shredding requirement is low, heat accumulation inside the shredder will make plastic components such as the enclosure and circuit boards melt down eventually. Moreover, electric characteristics of certain electronic elements will also be damaged, and consequently, the lifespan of the shredder will be shortened.

The applicant has recognized that the drawbacks described above have been ignored by persons of ordinary skill in the art. Furthermore, it has not yet been observed that a cooling technique may be applied to shredders.

SUMMARY OF THE INVENTION

One embodiment of the present invention is to provide a water cooling shredder which may be capable of realizing rapid heat dissipation, improving shredding efficiency of the shredder, as well as preventing electrical performance and physical components from being damaged due to overheating, thus possibly extending the lifespan of the shredder itself.

In one embodiment, the water cooling shredder of the present invention includes a power management unit and a shredding mechanism. The shredding mechanism may include a motor, a conveying mechanism and a pair of shredding rollers. The motor is powered by the power management unit. Torque of the motor is transferred by the conveying mechanism to the pair of the shredding rollers, thus causing shredding action of the shredding rollers. A heat dissipation device is provided on the motor to conduct heat outside of the motor itself.

The motor includes a stator portion, on which said heat dissipation device is mounted, and a rotator portion.

The heat dissipation device includes a metal component, a plurality of conduits, a pump and at least one metal tank for storage of water; a chamber is defined inside the metal component and tightly connected with the stator portion; the conduits are communicated with the metal tank and to the chamber of the metal component so as to define a water circulation circuit; the pump is electrically coupled with the power management unit, and is located at any position along the water circulation circuit so as to provide power to the circuit.

According to one embodiment of the invention, the metal component is tubular and has said chamber defined therein; the metal component runs across the outer circumference of the stator portion; the metal component has two ends, both of which are connected to the conduits respectively such that the water circulation circuit is defined.

According to another embodiment of the invention, the metal component is of an annular shape and tightly wraps the outer circumference of the stator portion; a chamber is defined inside of the metal component; the conduits communicate with the chamber of the component at two different locations thereon such that the circulation circuit is formed.

According to yet another embodiment of the invention, the metal component comprises a plurality of elongated and hollow rods and a plurality of transversal and hollow rods communicating with the plurality of elongated rods respectively; all of the elongated rods are parallel to one another and each of them is disposed in such way that they run across the stator portion; each transversal rod communicates with two adjacent elongated rods; the chamber is defined by all of the elongated and transversal rods together; the conduits communicate with the chamber at two different locations thereon such that the circulation circuit is formed.

In addition, at least one of the metal tanks is provided with a water supply port. A cover is disposed on the water supply port. The metal tank is disposed within an enclosure of the water cooling paper shredder at a location outside of the shredding mechanism. Alternatively, the metal tank may be disposed on the bottom portion of the enclosure of the shredder or disposed outside of the enclosure.

Compared with prior art, the invention has the following advantages. According to the invention, a dissipation device is directly mounted on the stator portion of the motor, thus the temperature of the stator portion can be reduced effectively by means of water cooling and finally, causing temperature reduction within the motor. Therefore, the paper shredder can be cooled with high efficiency. The motor will have relative constant work efficiency due to heat dissipation, and the motor will not stop operation during the paper shredding process, thus greatly improving total paper shredding capability. Setting the metal tanks externally further eliminates heat dissipation problems. This will greatly reduce, as much as possible heat remained inside the enclosure of the shredder and therefore, deformation of plastic elements will not occur. Furthermore, electrical performance of the electronic elements will not be influenced, thus extending the lifetime of the shredder.

DETAILED DESCRIPTION

Various embodiments of the invention will be described below in further detail with reference to the accompanying drawings.

Figure 1:
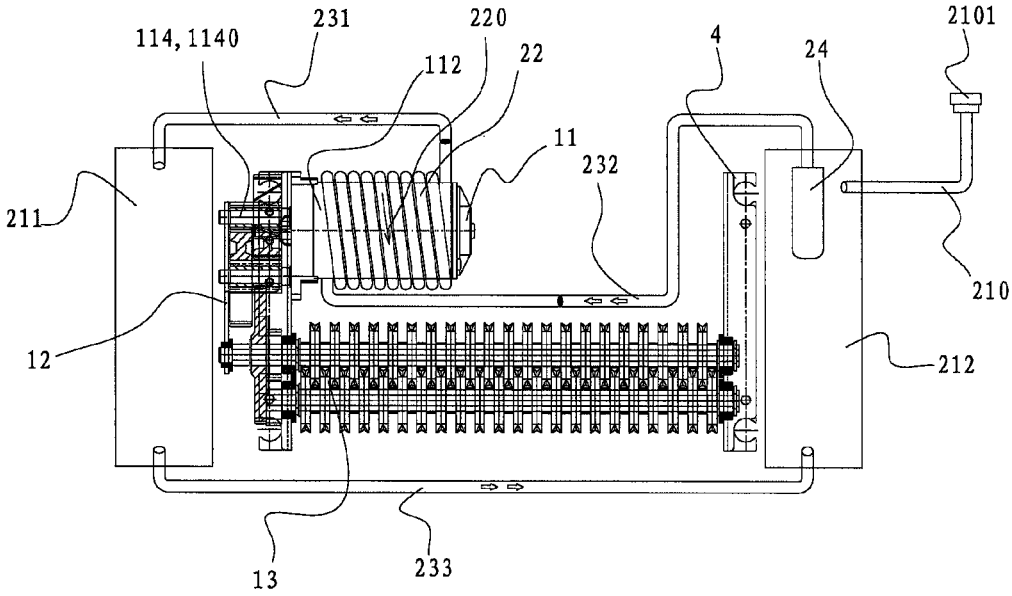
FIG. 1 shows a cross-sectional view of a cooling shredder according to a first embodiment of the invention, an enclosure of the shredder not shown.
Figure 5:
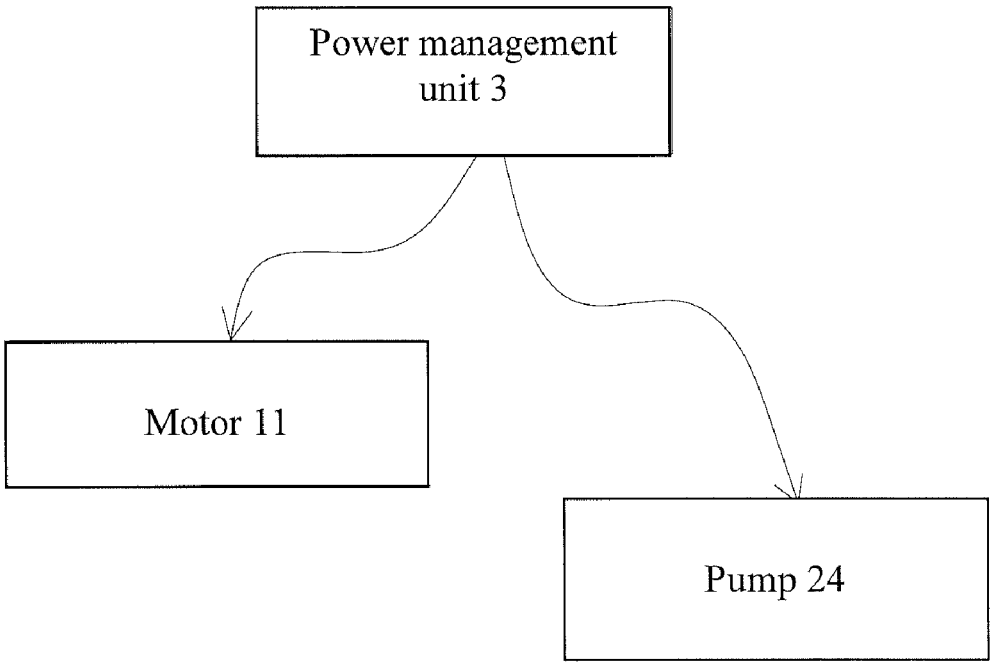
FIG. 5 illustrates an electrical connection of a power management unit of the shredder to a pump and the motor.

Referring to FIG. 1 which depicts a first embodiment of the invention, a shredding mechanism (as shown with reference numerals 11, 12 and 13 collectively) and a heat dissipation device (as shown with numerals 211-212, 22, 231-233 and 24) are illustrated. An enclosure of the shredder is not shown in FIG. 1. FIG. 5 illustrates a schematic electrical diagram common to all of the embodiments. FIG. 5 also illustrates a connection relationship among a power management unit 3, a motor 11 and a pump 24 of the paper shredding of the invention.

The shredding mechanism includes a motor 11, a conveying mechanism 12, a pair of shredding rollers 13 and a frame 4 for supporting all of these components. The power management unit 3 is connected to an external power supply so as to offer power to the motor 11. Driven by the power management unit, the motor 11 will result in rotation of the conveying mechanism 12 by a shaft of the motor 11. Torque of the motor 11 is transferred to the pair of shredding rollers 13 by the conveying mechanism 12. Accordingly, the rollers 13 begin to rotate when driven by the motor 11 and then perform paper shredding actions. Preferably, the conveying mechanism may be constructed by gear pairs. Alternatively, the conveying mechanism 12 may also be constructed by a conveying belt and a corresponding chain. In the case where additional pairs of shredding rollers 13 are provided in the shredding mechanism, a corresponding number of the conveying mechanisms should be provided so as to transfer torque of the motor 11 to newly added shredding roller 13. Obviously, a single motor 11 can be used to drive a plurality of shredding rollers 13.

The motor 11 includes a stator portion 112 and a rotator portion 114. The stator portion 112 is of a cylindrical shape due to utilization of a cylindrical core.

The heat dissipation device includes a metal component 22, a plurality of conduits (231, 232 and 233), two tanks (211, 212) and a pump 24. The two tanks 211, 212 can be mounted respectively at two lateral sides of the frame 4 of the shredding mechanism inside of the paper shredder. Alternatively, they may be installed at the bottom portion of the shredder. As an option, these tanks may also be located at locations outside of the shredder. Locations of the tanks may be designed by one of ordinary skill in the art to meet different heat dissipation effects. Typically, more effective dissipation may be obtained if the tanks 211, 212 are mounted outside rather than inside of the shredder.

The two tanks 211, 212 are used to store water therein such that water can circulate. It is noted that the number of the tanks is not limited to particular embodiments described therein. Rather, one or more tanks may be provided. However, at least one tank such as the second tank 212 of this embodiment should be provided with a water supply port. One end of a tube 210 communicates with the second metal tank 212. In addition, a cover 2101 is disposed at the other end of the tube 210. The cover 2101 is connected with the water supply port formed by the tube 210 in a threaded manner, thus facilitating opening of the cover 2101.

In this embodiment, the metal component 22 is tubular and has a chamber 220 defined therein. The shape of the metal component 22 may be similar to that of the conduits 231-233. The metal component 22 runs across the outer circumference of the stator portion 112 of the motor 11 so as to decrease the temperature of the stator 112 of the motor 11 due to the metal material of the component 12, thus effectively dissipating the heat from inside of the stator 112 of the motor 11. The metal component 22 has two ends, both of which are connected to the conduits 231 and 232 respectively such that a circulation circuit is defined.

The conduits (231-233) are formed by plural segments, including a first segment 231 one end of which is communicated with the front end of the metal component 22, while the other end thereof is communicated with the top portion of the first metal tank 211; a second segment 232 one end of which is coupled with the rear end of the metal component 22, while the other end thereof is coupled with the top portion of the second tank 212; and a third segment 233 both ends of which are connected to the bottom portion of the two metal tanks 211, 212 respectively. The number of the segments of the conduits is determined by number of the metal tanks 211, 212 and location of the pump 24. The conduits function as a communicating means and accordingly, the number thereof should not be limited to the embodiment.

In the embodiment of the invention, since the metal component 22 is made of the same material as that of the conduits (231-233) and they have similar function, the metal component 22 may be formed integrally with the conduits (231-233). In such case, part of the conduit may run across the external circumference of the stator 112 of the motor 11.

Because communication function of the conduits (231-233), the metal tanks 211-212, the conduits 231-233 and the metal component 22 together define a circulation circuit through which water coming from the metal tanks 211-212 can be circulated. To improve water circulation, one or more pumps 24 may be supplied. The pump 24 is electrically connected with the power management unit 3 in order to facilitate power control of the shredder. To reduce the number of connection joints among the conduits 231-233, the pump 24 is preferably located in one of the metal tanks 211-212, for example the second metal tank 212. The exit port of the pump 24 is connected to one end which is extended into the second metal tank 212, of the second conduit 232.

Driven by the pump 24, water is circulated in said circuit. When passing through the chamber 220 of the metal component 22 provided on the stator 112 of the motor 11, the heat accumulated on the stator 112 of the motor 11 is conducted via the metal component 22 to the water contained in the chamber 220, thus dissipating heat away by the water. Because the metal tanks 211-212 have a significant large area (it is often the case when the tanks are disposed outside of the shredder), it is easy to make heat inside of the tanks be exchanged with air outside of the tanks, hence temperature inside the tanks being able to be reduced rapidly. Due to water circulation, the temperature of the stator 112 of the motor 11 is kept constant, thus assuring the motor 11 will work correctly.

It should be understood by one of ordinary skill in the art that the pump 24 may be connected at any location to the circulation circuit.

Figure 2:
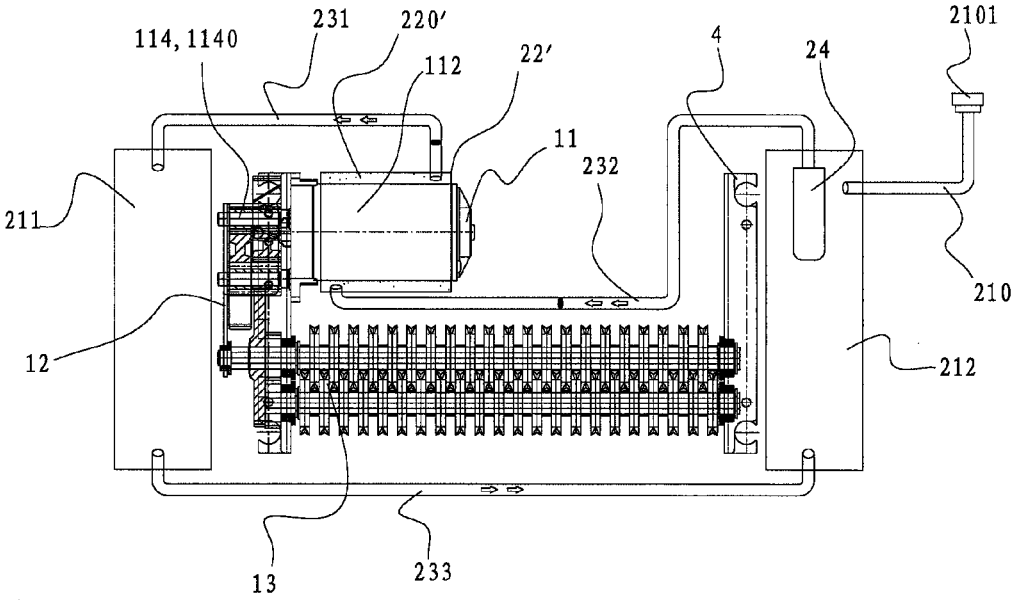
FIG. 2 shows a cross-sectional view of a cooling shredder according to a second embodiment of the invention, an enclosure of the shredder not shown.

Reference is made to FIG. 2 which illustrates a second embodiment of the invention. The difference with the first embodiment lies in the improvement to the metal component 22'. In the second embodiment, the metal component 22' has a shape of sleeve tube which conforms to the external circumference of the stator 112 of the motor 11. The metal component 22' is sleeved on the external circumference of the stator 112 of the motor 11. A chamber 220' is defined inside the metal component 22'. Similar to the first embodiment, one end of each first segment 231 and second segment 232 is connected to the metal component 22' at different locations and accordingly, both the segments 231, 232 are communicating with the chamber 220'. Connection joint location of the first segment 231 to the chamber 220' is different from that of the second segment 232 to the chamber 220'. Preferably as illustrated in this embodiment, the two connection joint locations are such that they are diametrically located. This will make water contained in the annular chamber 220' circulated more freely, thus getting more effective heat dissipation. The remaining aspects of this embodiment may be the same as that of the first embodiment.

Figure 3:
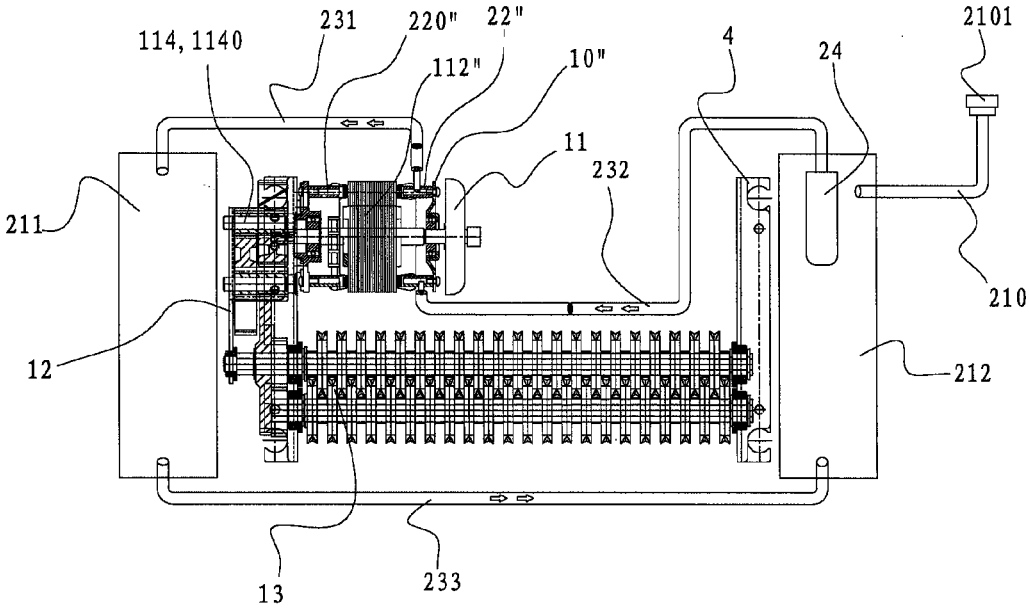
FIG. 3 shows a cross-sectional view of a cooling shredder according to a third embodiment of the invention, an enclosure of the shredder not shown.
Figure 4:
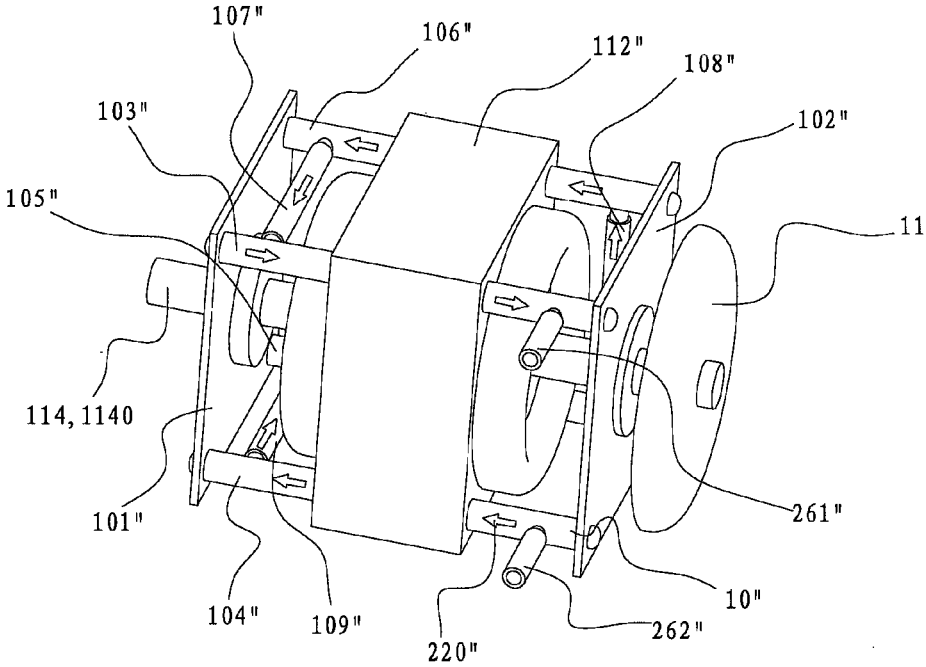
FIG. 4 shows a motor of FIG. 3 in perspective view.

FIGS. 3 and 4 show collaboratively the third embodiment of the invention. Similar to the first embodiment, the third embodiment takes some changes to the metal component 22" so as to adapt shape changes of the motor 11. More particularly, in this embodiment, a rectangular or square core is equipped on the stator 112' of the motor 11 and as a result, the stator 112" takes on rectangular or square shape. Though the metal component 22' of the first and second embodiments is also adapted to engage with the stator portion 112 of the third embodiment, changes in shape of the rectangular or square stator portion 112" in the third embodiment is more reasonable in design.

The stator portion 112" shown in FIG. 4 is of a square shape and defines four through holes at four corners thereof respectively. A support bracket 10" is installed on the motor 11. The support bracket 10" includes two plates 101", 102" disposed axially at two ends of the stator portion 112"; and four elongated rods 103", 104", 105" and 106" all of which are disposed in such way that they all extend across the through holes of the stator portion 112'. Both ends of each elongated rod are secured onto the two plates 101" and 102" respectively. Consequently, these elongated rods are parallel to one another. Three transversal rods 107", 108" and 109" are connected between two adjacent elongated rods respectively. All these elongated and transversal rods are of hollow construction. Two ends of each elongated rod are fastened on the plates 101" and 102" respectively. As a result, all these hollow elongated and transversal rods constitute collectively a chamber 220". It is therefore that, the support bracket 10" fixed onto the motor 11 of the embodiment, especially the construction defined by all the elongated and transversal rods 103"-106" and 107"-109" have their intended use similar to that of the metal component 22.

As described above, the metal component 22 has a chamber 220". In this embodiment, two connection tubes 261" and 262" are provided on different locations of the metal component 22. With respect to the first and second embodiments of the invention, the conduits 231-233 may be communicated with the chamber 220" by connecting the first segment of conduit 231 and second segment of conduit 232 with the connection tubes 261" and 262" respectively, thereby forming a complete water circulation circuit. The path along which the water inside the metal component 22 (defined by the support bracket 10") flows may be extended by reasonably setting the number of the transversal rods 107"-109" and interconnection of these rods with the elongated rods 103"-106", hence making heat absorption more efficient.

The conduits described above may be constructed of plastic or metal. The metal tanks may be positioned outside of the enclosure of the paper shredder.

Summarily, the invention has provided a technical solution for the paper shredder to realize water cooling of the motor. In addition, the motor of the shredder can stably work for a long time thanks to reasonable structure of the shredder of the invention, thus improving total paper shredding efficiency when a large number of papers must be shredded.

The invention claimed is:

1. A water cooling paper shredder, comprising:

a power management unit; and a shredding mechanism, wherein the shredding mechanism comprises a motor, a conveying mechanism and a pair of shredding rollers, the motor being powered by the power management unit, torque of the motor being transferred by the conveying mechanism to the pair of the shredding rollers, thus causing shredding action of the shredding rollers;

a heat dissipation device is provided on the motor to conduct heat outside of the motor itself;

wherein the motor comprises a stator portion on which said heat dissipation device is mounted and a rotator portion;

wherein the heat dissipation device comprises a metal component, a plurality of conduits, a pump and at least one metal tank for storage of water; a chamber is defined inside the metal component and tightly connected with the stator portion; the conduits are communicated with the metal tank and to the chamber of the metal component so as to define a water circulation circuit; the pump is electrically coupled with the power management unit, and is located at any position of the water circulation circuit so as to provide power to the circuit;

wherein the metal component comprises a plurality of elongated and hollow rods and a plurality of transversal and hollow rods communicating with the plurality of elongated rods respectively; all of the elongated rods are parallel one another and each of them is disposed in such way that they runs cross the stator portion; each transversal rod communicates with two adjacent elongated rods; the chamber is defined by all of the elongated and transversal rods together; the conduits communicates the chamber at two different locations thereon such that the circulation circuit is formed.

2. The water cooling paper shredder according to claim 1, wherein at least one of the metal tanks is provided with a water supply port.

3. The water cooling paper shredder according to claim 2, wherein a cover is disposed on the water supply port.

4. The water cooling paper shredder according to claim 1, wherein the metal tank is disposed within an enclosure of the water cooling paper shredder at a location outside of the shredding mechanism.

5. The water cooling paper shredder according to claim 1, wherein the metal tank is disposed on the bottom portion of the enclosure of the shredder or disposed outside of the enclosure.

* * * * *